United States Patent [19]

Gussis

[11] Patent Number: 4,566,537

[45] Date of Patent: Jan. 28, 1986

[54] HEAVY OIL RECOVERY

[75] Inventor: Gene L. Gussis, Plano, Tex.

[73] Assignee: Atlantic Richfield Co., Los Angeles, Calif.

[21] Appl. No.: 652,380

[22] Filed: Sep. 20, 1984

[51] Int. Cl.[4] ..... E21B 43/243

[52] U.S. Cl. ..... 166/261; 166/263; 166/269

[58] Field of Search ..... 166/261, 263, 269, 272, 166/303

[56] References Cited

U.S. PATENT DOCUMENTS

| | | | |
|---|---|---|---|
| 3,259,186 | 7/1966 | Dietz | 166/272 X |
| 3,375,870 | 4/1968 | Satter et al. | 166/263 X |
| 3,384,172 | 5/1968 | Hutsak et al. | 166/272 |
| 3,411,575 | 11/1968 | Connally, Jr. | 166/263 X |
| 3,441,083 | 4/1969 | Fitzgerald | 166/303 X |
| 3,460,621 | 8/1969 | Gum et al. | 166/263 |
| 3,515,212 | 6/1970 | Allen et al. | 166/261 X |
| 3,727,686 | 4/1973 | Prates et al. | 166/269 X |
| 3,997,004 | 12/1976 | Wu | 166/272 X |
| 4,068,715 | 1/1978 | Wu | 166/272 X |
| 4,495,994 | 1/1985 | Brown et al. | 166/263 X |

*Primary Examiner*—George A. Suchfield

*Attorney, Agent, or Firm*—M. David Folzenlogen

[57] ABSTRACT

The invention discloses a method of producing viscous immobile oil from a subsurface formation. Initially, steam is injected into the formation for a period of time by way of an injection well and a production well. Thereafter, a combustion-supporting gas is injected through the injection well into the top of the formation to form a fluid conductive path between injection and production wells. Subsequently steam is injected into the formation, preferably near the bottom of the formation and flows through the fluid conductive path. Heated oil adjacent the top of the formation is produced by steam drag into the producing well or wells.

12 Claims, 1 Drawing Figure

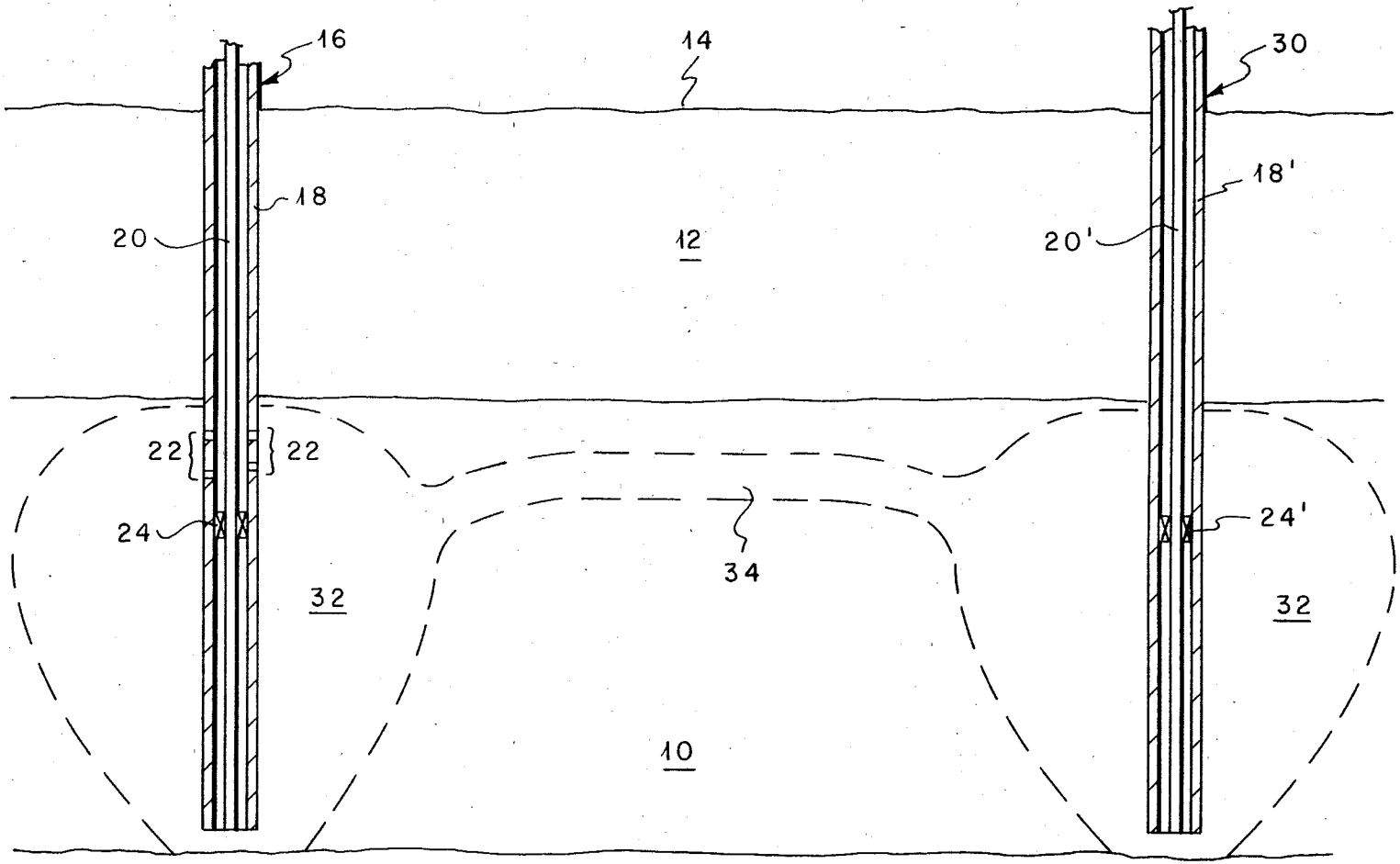
30
18'
20'
24'
32
14
12
34
10
16
18
20
22
22
24
32

HEAVY OIL RECOVERY

BACKGROUND OF THE INVENTION

This invention relates to the recovery of heavy, viscous, immobile oil from a subterranean formation. More particularly, it relates to a three stage oil recovery process wherein steam huff and puff is used to produce oil and create voidage in the formation, and in situ combustion in the top of the formation is used to create communication between injection and production wells, and steam injection is used to drag oil out of the formation.

Within subsurface formations reside vast quantities of viscous, immobile oils not recoverable by conventional oil production procedures. Various techniques have been proposed for heating such formations to reduce the viscosity of such hydrocarbons so that the oil becomes mobile and can be flowed into a production well. Three known techniques steam huff and puff, steam drive and forward in situ combustion are pertinent to this disclosure. In this disclosure, these three known techniques are combined and carried out in a special sequence and manner. The steam huff and puff and in situ combustion stages are carried out for additional or different purposes.

SUMMARY OF INVENTION

The invention discloses a method of producing viscous immobile oil from a subsurface formation. Initially, steam is injected into the formation, preferably, the bottom thereof, by way of an injection well and a production well. The wells may be part of a pattern of wells (for example, a five-spot pattern). Thereafter, injection is ceased and the wells are used to produce fluids from the formation. Production may be preceded by a shut-in period allowing the steam to soak and transfer heat to oil in the formation. This cycle of steam injection followed by backflowing the well produces oil from the formation and is designed to create voidage in the formation for the second stage of the process. This voidage is needed to permit adequate oxygen injection for the second stage. Cyclic steam injection and production may be repeated a number of times to produce the necessary voidage. Thereafter, an oxygen-containing combustion supporting gas (for example, air enriched in free oxygen) is injected by way of the injection well into the top of the formation to burn oil in the top of the formation and form a fluid conductive path between injection and production wells. In formations bearing heavy, immobile oils communication between injection and production wells is needed to maintain a large enough oxygen flux to sustain combustion. The oxygen combustion-supporting gas must be injected into the top of the formation to accomplish the objectives of this invention. After a fluid conductivity between injection and production wells is formed and measurable oxygen breaks through, in situ combustion may be discontinued or continued until it is determined that oxygen injection should be discontinued. Subsequently steam is injected into the formation, preferably near the bottom of the formation. Steam rises up and steam and condensed hot water flow over the oil through the conductive path created in the second stage of the process. Heated oil adjacent the top of the formation is produced by steam drag into the producing well or wells. The steam drag of the third stage of the process recovers much more oil than would be produced by conventional steam drive.

The FIGURE is a schematic diagram of an embodiment of the present invention.

DESCRIPTION OF PREFERRED EMBODIMENTS

This invention relates to the recovery of oil from a subsurface formation. For purposes of this invention, a formation is a subsurface reservoir or stratum or strata in a reservoir chosen for production. For this invention, a formation contains heavy hydrocarbons that cannot be recovered economically by conventional oil production procedures (for example, the lower Ugnu formation in Alaska). The hydrocarbons are considered practically non-flowing and immobile under formation conditions. It has been discovered that a substantial percentage of the hydrocarbons in place in such formations can be successfully and economically recovered by steam drag techniques if the formation is properly prepared in advance of steam injection for steam drag purposes.

Accordingly, a formation into which at least two wells extend from the surface is selected for production. The wells will be drilled and completed by any suitable procedure and apparatus for use in accordance with this disclosure. The wells permit flow of fluids into and out of the formation. For the last stage of the process of this invention, one of the wells will be used as an injection well and one as a production well. Use of the wells may be switched or alternated. Though it is only necessary that one injection and one production well be provided for carrying out this invention, it is highly desirable that the wells be used in a pattern containing more than one production well and possibly more than one injection well. If more than one production well is used, the production wells preferably will be located on opposed sides of the injection well and the production wells will be usually equally spaced laterally from the injection well. However, this distance may be varied if desired. The distances between the wells will depend upon reservoir conditions and the injection pressures and rates to be used in the three stages of the process.

The FIGURE shows a subterranean formation 10 which contains heavy hydrocarabons which cannot be recovered economically by conventional oil production procedures. Formation 10 is positioned beneath an overburden 12 and is penetrated from the surface by a first well 16 and a second well 30. First well 16 is completed and cased (casing 18) to near the bottom of formation 10 and contains a tubing 20 which extends to near the bottom of casing 18. Casing 18 includes perforations 22 near the top of formation 10 and a packer 24 between the inner diameter of casing 18 and the outer diameter of tubing 20 and below perforations 22. Second well 30 is substantially the same as first well 16 and includes a casing 18', a tubing 20' and a packer 24'.

In the first stage of the process of this invention, steam, usually of 60 to 90 percent or higher quality, is injected into the lower part of the formation and preferably into the bottom of the formation for a period of time by way of both wells. The rate of steam injection, the total amount, and the steam pressure and temperature will be selected in accordance with the purposes for which the steam is injected and determined in accordance with known principles. In general, steam is injected into the subsurface formation 10 in quantities sufficient to heat a predetermined distance of the formation radially from the wellbore. This distance changes with time and with a number of injection and backflowing steps performed. Pressures commonly range between 200 and 2500 psi dependent upon the depth of the formation and the permeability of the formation. The steam is injected at a predetermined rate usually stated in pounds per hour or barrels per day (cold water equivalent) and may be injected for periods of a few days to six months and longer dependent upon the nature of the formation at the time. The steam may be combined with foaming, surfactant, solvent or caustic agents and/or inert gases like carbon dioxide, flue gas, etc. After a preselected period of time, a zone of increased voidage, shown in the FIGURE as a zone 32 around each well is formed and steam injection into each well is ceased. Each well is then backflowed, usually by pumping, to produce fluids including oil from the formation. In one variation, the injection step is followed by a period of shut-in prior to producing fluids from the formation. This variation is called steam soaking. Steam soaking maximizes transfer of heat from the steam to the inplace oil. For this invention, the primary purpose of steam injection followed by backflowing is to create voidage in the formation in order that adequate oxygen may be injected for the second stage of the process. The cycles of steam injection followed by production may be repeated until the desired amount of voidage has been developed.

After the necessary voidage has been formed, a forward in situ combustion stage is initiated and carried out. In forward in situ combustion, carbonaceous material in the formation is ignited in the presence of an oxygen-containing gas for providing the combustion front. Then the oxygen-containing gas is caused to flow in the same direction as the combustion front is to be moved. Accordingly, a combustion-supporting gas, such as air, air enriched in oxygen, flue gas to which oxygen has been added, or the like (with or without supplemental fuel), is injected into the top of the formation through one of the wells selected for use as an injection well. For purposes of discussion first well 16 is shown as the injection well. The gas is injected into the top of formation 10 through perforations 22. Preferably, the combustion-supporting gas will contain at least 25 percent oxygen. The key to performing combustion is maintaining a large enough oxygen flux to sustain the combustion front. With a heavy, immobile oil, it is necessary that there be created voidage in the formation and that communication between injection and production wells be developed rapidly for a high oxygen rate. To encourage more rapid gas breakthrough and communication and obtain high oxygen flux, it is essential in this invention that the oxygen-containing gas be injected into the top of the formation. When combustion begins, produced gases such as carbon dioxide and methane override the formation. This enables the gas to breakthrough at the production well in a shorter period of time. After gas breakthrough, oxygen flux significantly increases which is highly desirable for the process of this invention. The injection of the combustion-supporting gas into the top of the formation may be accomplished by appropriately locating packers or by injecting inert fluids into the lower part of the formation while injecting the combustionsupporting gas into the upper part of the formation. The combustion-supporting gas flow and the elevated temperature of the formation adjacent the injection well caused by the first stage of the process will normally result in spontaneous ignition of the carbonaceous matter thereby creating the in situ combustion front. Conventional ignition procedures, such as electrical heaters, catalytic heaters, downhole igniters with or without thermocouples, chemical catalyst such as phosphorus, triethylborane, linseed oil, and the like, may be employed in cases where spontaneous ignition is not achieved. The flow of combustion-supporting gas is adjusted while moving the combustion front toward the second well to maintain a continuous flow of the combustion-supporting gas, combustion products, and increase the temperature in the top part of the formation. The injection of the combustion-supporting gas and movement of the combustion front is maintained at least until measurable oxygen breakthrough occurs at the second or production well (for example, one to two years). The primary purpose of in situ combustion is to develop a mobile fluid link or conductive flow path, shown in the FIGURE as a link 34, between the injection and the production wells. However, if desired, the amount of hydrocarbons, if any, recovered from the formation during the in situ combustion stage may be correlated to the flow of combustion-supporting gas so that a maximum production of recoverable hydrocarbons is obtained. The combustion front movement produces large amounts of heat energy which are partially dissipated in the formation by convection, conduction and radiation. This heating effect, along with the products of combustion, produces a thinning of the immobile oil in the top of the formation. The heat-thinning and other effects of the combustion front cause the formation fluids to flow into the production well. Suitable monitoring means may be employed to provide the functions necessary for determining the propagation of the combustion front and its temperature. Such means are known to the art and are not discussed herein. Water may be injected with the combustion-supporting gas to increase the amount of steam generated by the combustion front and to control the temperature of the combustion front. If water is injected, the amounts injected will not be so great as to extinguish the combustion front.

When injection of combustion-supporting gas has ceased and the necessary fluid flow channel has been formed in the top of the formation, steam is injected into the formation by way of injection well 16. Preferably, the steam will be injected into the lower part of the formation and preferably into the bottom of the formation. The steam may be combined with foaming, surfactant, solvent or caustic agents and/or inert gases like carbon dioxide, flue gas, etc. The pressure and temperature and rate of injection will be governed by the nature of the formation and other conditions known to the art. Generally, the temperature of the steam will exceed 300° F. The steam is injected in a sufficient amount to flow through the conductive flow channel created by in situ combustion. The steam injected into the formation rises and flows through previously created. Steam and condensed hot water flow along the top of the reservoir where mobile water and gas join injection and production wells. Oil thus is heated and produced from the top of the reservoir first. This method of production is referred to herein as steam drag. Greatest production occurs along direct paths between the injection and production wells. Simulations of ten years of performance predict 40–50 percent recovery and higher of the original oil in place. Average production rates will depend on the nature of the formation. For a five-spot pattern in the Ugnu formation in Alaska, numerical simulation indicates that average rates of production will exceed 1000 barrels per day per pattern.

Various modifications of the disclosed embodiments, as well as other embodiments of the invention, may be apparent to persons skilled in the art upon reference to this description. It is therefore contemplated that the appended claims will cover any such modifications or embodiments as fall within the true scope of the invention.

I claim:

1. A method for the recovery of viscous, immobile oil from a subsurface formation bearing said oil wherein there are at least two wells completed into said formation comprising:

(a) injecting steam into said formation by way of a first of said wells for a period of time;

(b) ceasing injection of steam by way of said first well;

(c) producing fluids from said formation through said first well, thereby creating voidage in said formation adjacent said first well;

(d) injecting steam into said formation by way of a second of said wells for a period of time;

(e) ceasing injection of steam by way of said second well;

(f) producing fluids from said formation through said second well, thereby creating voidage in said formation adjacent said second well;

(g) subsequently injecting an oxygen-containing combustion supporting gas into the top of said formation and creating a combustion front in the top of said formation;

(h) continuing injection of said oxygen-containing combustion-supporting gas into the top of said formation at least until measurable oxygen breaks through at said second well;

(i) ceasing injection of said oxygen-containing combustion supporting gas;

(j) thereafter injecting steam into the lower part of said formation by way of said first well, and (k) producing oil at said second well.

2. The method of claim 1 wherein said oxygen-containing combustion supporting gas is at least 25% free oxygen.

3. The method of claim 1 wherein after steps "(b)" and "(e)", the wells are shut-in for a period before commencing steps "(c)" and "(f)".

4. The method of claim 1 wherein in steps "(a)" and "(d)", the steam is injected into the bottom of said formation.

5. The method of claim 4 wherein said oxygen-containing combustion supporting gas is at least 25% free oxygen.

6. The method of claim 4 wherein after steps "(b)" and "(e)", the wells are shut-in for a period before commencing steps "(c)" and "(f)".

7. The method of claim 1 wherein steps "(a)" through "(f)" are repeated at least once before commencing step "(g)".

8. The method of claim 7 wherein said oxygen-containing combustion supporting gas is at least 25% free oxygen.

9. The method of claim 7 wherein after steps "(b)" and "(e)", the wells are shut-in for a period before commencing steps "(c)" and "(f)".

10. The method of claim 7 wherein in steps "(a)" and "(d)", the steam is injected into the bottom of said formation.

11. The method of claim 10 wherein said oxygen-containing combustion supporting gas is at least 25% free oxygen.

12. The method of claim 10 wherein after steps "(b)" and "(e)", the wells are shut-in for a period before commencing steps "(c)" and "(f)".

* * * * *